United States Patent [19]

Bernstein

[11] Patent Number: 4,938,359

[45] Date of Patent: Jul. 3, 1990

[54] RECEPTACLE FOR RETURNABLE BEVERAGE CONTAINERS

[76] Inventor: Howard Bernstein, 145 Nassau La., Island Park, N.Y. 11558

[21] Appl. No.: 401,498

[22] Filed: Aug. 29, 1989

Related U.S. Application Data

[63] Continuation of Ser. No. 209,077, Jun. 17, 1988, abandoned.

[51] Int. Cl.[5] ..... B65D 21/00; B65D 85/62

[52] U.S. Cl. ..... 206/509; 206/203; 206/503; 220/21

[58] Field of Search ..... 206/144, 202, 203, 427, 206/428, 503, 505, 509, 513; 220/DIG. 15, 21; 280/33.992, DIG. 4

[56] References Cited

U.S. PATENT DOCUMENTS

| | | | |
|---|---|---|---|
| 2,530,481 | 11/1950 | Rawn, Jr. | 220/DIG. 15 |
| 2,565,299 | 8/1951 | Erickson | 220/21 |
| 2,633,278 | 3/1953 | Muniz | 280/33.992 |
| 2,645,375 | 7/1953 | Topfer | 215/10 |
| 3,067,896 | 12/1962 | Berg et al. | 215/10 |
| 3,223,280 | 12/1965 | Kazimier | 206/203 |
| 3,327,885 | 6/1967 | Carle et al. | 220/21 |
| 3,756,396 | 9/1973 | Kilroy | 206/509 X |
| 3,841,519 | 10/1974 | Stromberg | 220/21 X |
| 4,029,209 | 6/1977 | Frahm | 206/203 X |
| 4,673,625 | 6/1987 | McCartney | 220/94 X |
| 4,757,910 | 7/1988 | Box | 206/503 X |

*Primary Examiner*—Allen M. Ostrager
*Attorney, Agent, or Firm*—Collard, Roe & Galgano

[57] ABSTRACT

A receptacle for beverage containers is disclosed. The receptacle has a rigid bottom portion consisting of a plurality of framework members. A plurality of spring fingers extend generally vertically up from the bottom portion to secure at least the bases of the beverage containers. With this construction, the beverage containers are retained in a vertical position. The receptacle has side walls extending generally vertically upward from the bottom portion to define a generally open top for the receptacle. The side walls includes slots for the attachment of a handle so that the receptacle can be lifted. Each receptacle is designed so that it can be mechanically interlocked with the top or bottom of an adjacent identical receptacle.

12 Claims, 2 Drawing Sheets

RECEPTACLE FOR RETURNABLE BEVERAGE CONTAINERS

This application is a continuation of Ser. No. 209,077 filed June 17, 1988, now abandoned.

BACKGROUND OF THE INVENTION

1. Field of the Invention

The present invention relates to the field of receptacles made for carrying a plurality of returnable beverage containers. More specifically, the present invention relates to the field of plastic molded receptacles for carrying returnable beverage cans and bottles, which receptacles can be attached to the front or side of a standard shopping cart.

2. Description of the Prior Art

Containers and baskets for carrying reusable beverage containers are known in the prior art. U.S. Pat. No. 4,300,697, issued to R. E. Dickens, discloses a wire container for returnable beverage cans. The wire container is divided into a plurality of equal compartments by plurality of equally spaced divider members extending transversely between opposed sides of the frame members. This type of construction is very complex and, therefore, costly. In addition, the container disclosed by Dickens is not capable of being stacked nor is there any teaching for attaching the container to a shopping cart.

Many other wire containers are also been well known in the art. U.S. Pat. No. 2,333,954, issued to W. P. Rocker et al, discloses a collapsible carrier for milk bottles. Again, the wire construction is very complex. U.S. Pat. No. 2,985,332, issued to W. H. Fredrick, also shows a collapsible wire container for storing various articles. U.S. Pat. No. 3,347,404, issued to T. M. McIntyre, discloses a holder for a plurality of various containers. U.S. Pat. No. 4,329,977, to R. H. Orter, discloses a portable cooker having two telescoping halves. Each half includes opposed handles which allow the cooker to be picked up and rotated. U.S. Pat. No. 4,610,368, issued to T. Hasebe, discloses a tablewear basket for receiving and holding spoons, forks and knives, to be washed by a tablewear washer. A wire support is shown which maintains the silverwear basket in the upright position.

The present invention concerns a stackable receptacle for holding up to twelve empty returnable cans in an upright manner so as to prevent them from spilling any remaining contents therein. Normally, the bottom of the receptacle defines twelve supports arranged in a circle for receiving the empty cans. Support for the cans would be provided in a manner somewhat akin to the glass racks in a dishwasher whereby the base of the can would be supported by three upright supports. These three upright supports or fingers are inwardly sprung to capture the base of a vertically oriented beverage container. Similarly, the top end of the can would be less than the overall height of the carrier, so that two or more of these racks could be stacked one atop the other. The invention also contemplates that the racks could be joined together by mechanical male/female interlocks, for example, a threaded coupling, to permit lifting of two or more racks or receptacles simultaneously. Also, a handle may be mounted onto the side walls of the rack or receptacle so that one or even a stack of two or more receptacles may be lifted in unison and brought to the supermarket for attachment to the standard shopping cart.

SUMMARY OF THE INVENTION

It is an object of the present invention to provide a receptacle or rack for returnable beverage containers.

It is also an object of the present invention to provide a receptacle made from molded plastic, for returnable beverage containers.

It is yet another object of this invention to provide a receptacle or rack that can be stacked one upon another with some form of mechanical interlocking between the receptacles.

It is still an additional object of this invention to provide a receptacle to which a handle can be attached so that either one or a stack of the receptacles may be lifted.

It is still one additional object of this invention to provide for a receptacle which can be easily attached to a standard shopping cart when returning disposable beverage containers to the supermarket.

It is yet another object of the present invention to provide a receptacle capable of storing returnable beverage containers in the vertical position.

It is still one further object of this invention to provide a rack or receptacle which includes spring fingers to capture and hold at least the base of the beverage containers to thereby prevent spilling of any contents therein.

It is also a further object of the invention to provide a receptacle which can hold glass bottles vertically and spaced apart to eliminate the possibility of breakage.

These and other objects of the invention are disclosed in a preferred embodiment of the invention which includes a receptacle for returnable beverage rack which has a generally open top. The receptacle or rack has a rigid bottom portion consisting of a plurality of framework members. A plurality of spring fingers extend generally vertically upward from the bottom portion to secure at least the bases of said beverage containers. These fingers hold the containers in a vertical position. The receptacle has side walls extending generally vertically upward from the bottom portion to define the generally open top of the receptacle. The side walls includes slots for the attachment of a handle so that the receptacle can be lifted. Each receptacle or rack is so designed that it can be mechanically interlocked with the top or bottom of an adjacent identical receptacle. When so interlocked, the entire stack of receptacles may be lifted with one handle attached to the uppermost receptacle.

Other objects and features of the present invention will become apparent from the following detailed description considered in connection with the accompanying drawings, which disclose several embodiments of the invention. It is to be understood that the drawings are to be used for the purpose of illustration only, and not as a definition of the limits of the invention.

BRIEF DESCRIPTION OF THE DRAWINGS

In the drawings, wherein similar reference characters denote similar elements throughout the several views.

DESCRIPTION OF THE PREFERRED EMBODIMENT

Figure 1:
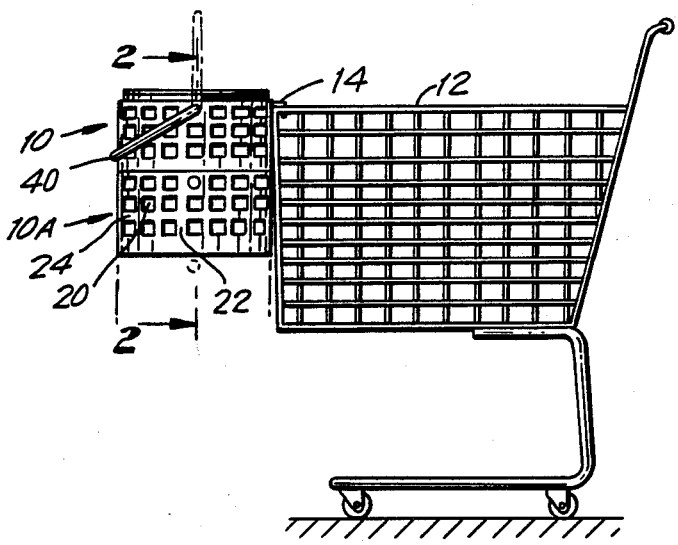
FIG. 1 is a side view of two receptacles of the present invention attached to the front end of a standard shopping cart.
Figure 2:
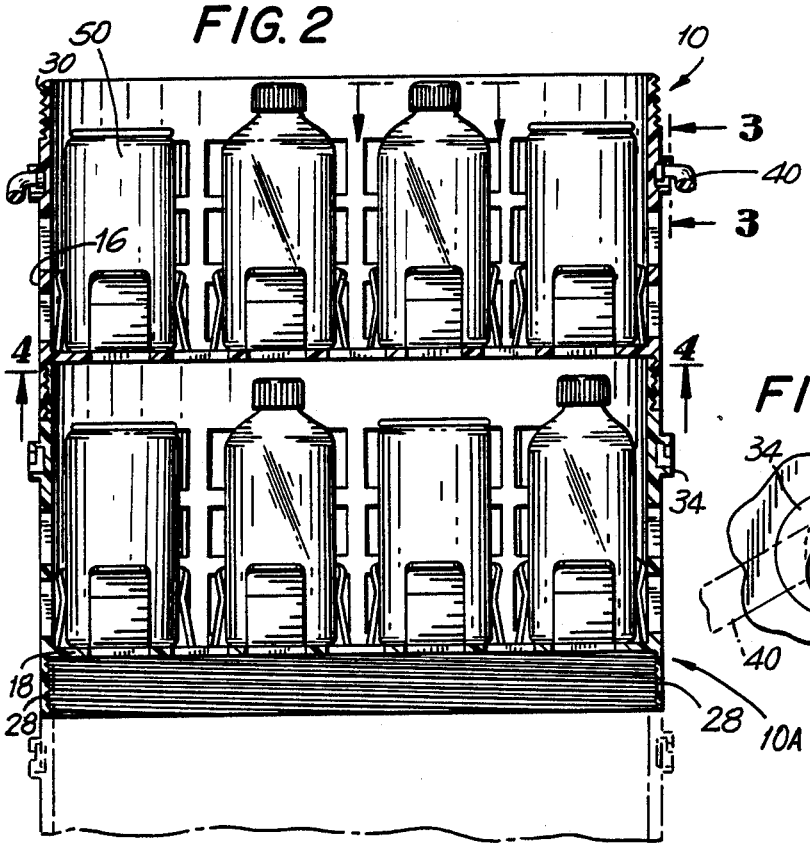
FIG. 2 is a cross-sectional view of the receptacles shown in FIG. 1 along the lines 2—2.

As best illustrated in FIGS. 1 and 2, there are shown stackable receptacles generally denoted as 10 and 10*a*. It should be noted that the receptacle shown in FIGS. 1 and 2 are actually two of the receptacles (10, 10*a*) already stacked one upon another. As can be seen in FIG. 1, each receptacle is adapted to be hooked over the edge of a standard shopping cart 12 by a hook member 14.

In the preferred embodiment, the receptacle 10, 10*a* is composed of a generally cylindrical side wall 16 and a generally circular bottom portion 18. The generally cylindrical side wall 16 extend vertically upward from the bottom portion 18 thereby defining an opening at the top of the receptacle 10. In the preferred embodiment, the side wall 16 is molded from plastic to thereby define a cross-hatch of openings. The openings are defined by plastic framework 20. The framework 20 of the side wall 16 is composed of vertical strips 22 and horizontal strips 24 which could either be molded in the same plane or stamped from a sheet of plastic material. The utilization of framework members 22 and 24 to define openings in the side wall results in a lighter and less costly construction than would result by leaving the side walls 16 solid since less material is required.

Figure 3:
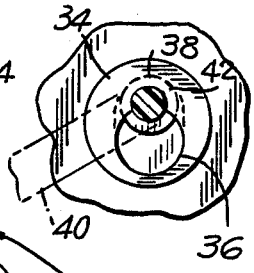
FIG. 3 is a view of the handle slot arrangement along the lines 3—3 of FIG. 2.
Figure 4:
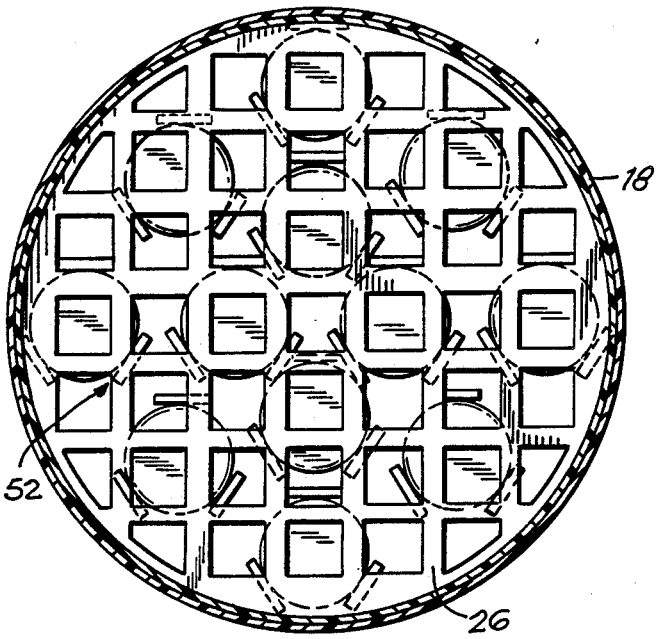
FIG. 4 is a cross-sectional view of the bottom of the receptacle of the present invention along the lines 4—4 of FIG. 2.

As can be best seen in FIG. 4, the bottom portion 18 is also made up of a grid work of horizontal framework members 26 all located in the same plane as base portion 18. Again, the framework members 26 form openings in the bottom portion 18 to lighten the receptacle and to reduce the material required to mold the container 10. In the preferred embodiment, the base portion 18 has a generally circular downwardly extending flange 28. The downwardly extending flange 28 has a diameter slightly greater than a circular top flange 30 on side wall 16 so that the receptacles may be stacked one on another with the bottom flange 28 of receptacle 10 overlapping the top flange 30 of the lower receptacle 10*a*. A threaded means for mechanically attaching the two receptacles 10 and 10*a* is provided. As can be seen if FIG. 3, the upper flange 30 has male threads thereon and the lower flange 28 has female threads on the inside thereof so that receptacles 10 and 10*a* may be screwed together thereby forming an interlocked stack. The lower flange 28 helps provide additional height to the assembly 10, 10*a* so that taller containers may be stored in receptacle 10*a* even with receptacle 10 attached thereto.

As can be seen in FIGS. 1 and 3, the preferred receptacle 10 or 10*a* has a pair of slots 34 located on and molded into the side walls 16 and diametrically opposed (oriented at 180°) one from another. Each slot has a larger diameter opening 36 partially intersecting with a smaller diameter opening 38. The openings 36 and 38 are adapted to receive a handle 40. The handle 40 is made from a plastic strap or rod bent in a generally U-shaped form and having generally T-shaped inwardly extending flange portions 42 adapted to be received inside the slot opening 36. The T-shaped flange 42 has an end diameter of the "T" which can be accommodated by the opening 36 and a smaller diameter sized to engage slot opening 38 with the larger diameter captured within or behind smaller slot opening 38. The slot opening 38 and the smaller diameter of flanges 42 may be dimensioned to have a slight interference fit thereby preventing accidental removal of the handle 40 from the container 10 after the flanges 42 are engaged into slots 34. As is seen in FIG. 1, once the receptacles 10 and 10*a* are mechanically joined together, a handle 40 is only required in the upper receptacle 10, although all receptacles are identical and include the above-mentioned slot arrangement.

As can be seen in FIG. 2, the height of the beverage containers generally denoted as 50 when inserted is slightly less than the height of side wall 16 of the receptacle 10. This insures the ability to stack and mechanically interlock any number of the receptacles 10.

Figure 5:
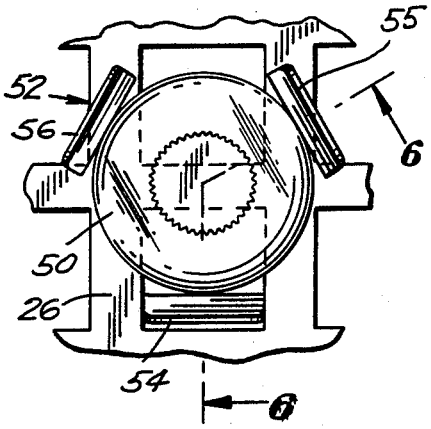
FIG. 5 is an enlarged top view of the beverage container being held within the receptacle of the present invention.
Figure 6:
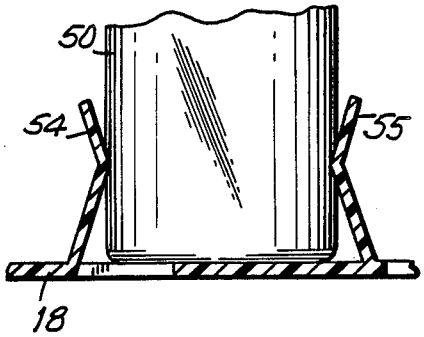
FIG. 6 is a side view of the beverage container holding arrangement along the lines 6—6 of FIG. 5.

As can be best seen in FIGS. 5 and 6, the base portion 18 includes a support structure generally denoted as 52 molded to the base portion 18. The support structure 52 is made up of three supports or spring fingers 54, 55 and 56. As can be seen in FIG. 6, the spring fingers 54, 55 and 56 are inwardly sprung towards beverage container 50 and maintain the container in the vertical. This arrangement allows easy insertion of the beverage can or container 50 into the support structure 52 as will be described below.

The preferred containers 10 and 10A are injection molded in one piece. Therefore, the support structures 52 are formed on the framework members 26 at the time the entire container is molded.

As can be seen in FIG. 4, the preferred bottom portion 18 is so dimensioned to accomodate twelve beverage containers 50. Consequently, twelve of the support structures 52 would be formed onto the framework 26 which forms bottom portion 18. Normally, eight or nine of the beverage containers 50 are positioned immediately inside the side wall 16 with the remaining three or four beverage containers located around the center of bottom portion 18. Of course, the diameter of bottom portion 18 can be varied and the number of containers may be varied as long as a resultant receptacle is not overly bulky.

In its use, a beverage container receptacle 10 is filled with beverage cans or containers 50 by inserting each can or bottle vertically within the support structure 52. In doing so the resilient fingers 54, 55 and 56 are spread as the beverage container is inserted with the beverage container maintained in the vertical position by the generally equal inward force of the fingers. Once a receptacle such as 10*a* is completely full, a second receptacle such as 10 may be fixedly attached to the top of the first receptacle 10*a* in the manner hereinbefore described. Then twelve additional beverage containers may be stacked within the second receptacle 10, as is shown in FIG. 2. Upon a trip to the supermarket, the handle 40 is inserted onto receptacle 10 by placing the flanges 42 into the openings 36 and pulling upwardly to engage the "T" end of flanges 42 within openings 38. The two containers may then be lifted and carried to the supermarket. Upon arrival at the supermarket, the stack configuration is hooked to the front of a standard shopping cart by hook 14. The user of the invention may then proceed with shopping without having to worry about burying bags full of beverage containers in the bottom of the shopping cart with the groceries to be purchased. Upon reaching the appropriate point in the store, the beverage cans may be returned by removing the twelve beverage containers in the top receptacle, unscrewing the top receptacle from the bottom receptacle and then returning the beverage containers in the bottom receptacle. Then either assembling both receptacles together once again or merely hanging both on the front of the cart with the hooks 14, since the front of most grocery carts contain a plurality of horizontally-running wire cross members. It should be noted that the openings between framework members 22 and 24 provide a finger hold for the screwing and unscrewing of the receptacle 10 and 10a.

While only several embodiments of the present invention have been described, it is obvious that many changes and modifications may be made thereunto, without departing from the spirit and scope of the invention.

What is claimed is:

1. A receptacle for returnable beverage containers having a generally open top, comprising:

a rigid bottom portion;

means associated with said bottom portion to releasably secure at least bases of each of said beverage containers whereby said beverage containers are retained in a vertical position;

generally vertical side wall means extending from said rigid bottom portion to define said generally open top of said receptacle; and mechanical interlock means associated with said bottom portion and said side walls means for releasably locking said receptacle to the top or bottom of an adjacent, identical receptacle.

2. A receptacle as set forth in claim 1 further including removable handle means associated with said side wall means to provide for lifting of said receptacle.

3. A receptacle for returnable beverage containers as set forth in claim 2, wherein said handle means is formed from plastic into a generally U-shaped member having a handle portion at one end thereof and generally circular inwardly extending flanges at the ends thereof opposite said handle portion.

4. A receptacle for returnable beverage containers as set forth in claim 3, wherein said side wall means includes a slot having a first diameter section for initially receiving said flanges of said handle means and a second diameter section located vertically above said first diameter, said second diameter section being slightly less than the diameter of said inwardly extending flanges of said handle means and capable of rotatingly capturing said flange portions of said handle means.

5. A receptacle for returnable beverage containers as set forth in claim 1, wherein the cross section of said open top defined by said side wall means is slightly less than the cross section of said bottom portion to allow said receptacle to be telescopically engaged to an adjacent, identical receptacle.

6. A receptacle as set forth in claim 5, wherein said bottom portion has a threaded flange portion extending in a direction parallel but opposite to said vertically extending side wall means, and wherein said side wall means is threaded adjacent said open top to allow said threaded flange of one of said receptacles to be threaded into the top of an adjacent receptacle.

7. A receptacle for returnable beverage containers as set forth in claim 1, wherein said side wall includes means for mounting said receptacle on a standard shopping cart.

8. A receptacle for returnable beverage containers as set forth in claim 1, wherein said means to secure at least the bases of said beverage containers includes a plurality of finger means affixed to said bottom portion and capable of clampingly engaging said base of said beverage containers.

9. A receptacle for returnable beverage containers as set forth in claim 1, wherein said base portion is generally circular and said side wall means is generally cylindrical.

10. A receptacle for returnable beverage containers as set forth in claim 1, made of plastic.

11. A receptacle as set forth in claim 10, wherein said receptacle is injection molded.

12. A receptacle for returnable beverage containers as set forth in claim 1, wherein said rigid bottom portion has a plurality of horizontally-running framework members and said side walls have a plurality of horizontally and vertically extending framework members so as to define a grid-like pattern in said rigid bottom portion and said side walls, respectively.

* * * * *